US006250039B1

(12) United States Patent
Karten et al.

(10) Patent No.: US 6,250,039 B1
(45) Date of Patent: Jun. 26, 2001

(54) CHANNEL BAR ASSEMBLY FOR MODULAR DISPLAY SYSTEMS

(75) Inventors: Stuart Karten, Venice; Robert Blumenfeld, Sherman Oaks; Dennis Schroeder, Hermosa Beach; Duane Lee, Orange, all of CA (US)

(73) Assignee: Abex Display Systems, North Hollywood, CA (US)

( * ) Notice: Subject to any disclaimer, the term of this patent is extended or adjusted under 35 U.S.C. 154(b) by 0 days.

(21) Appl. No.: 09/510,187

(22) Filed: Feb. 22, 2000

(51) Int. Cl.[7] ..... E04H 12/18
(52) U.S. Cl. ..... 52/645; 52/646; 40/610
(58) Field of Search ..... 52/109, 646; 40/604; 403/72, 301, 309, 318, 319

(56) References Cited

U.S. PATENT DOCUMENTS

| | | | | |
|---|---|---|---|---|
| 1,714,698 | | 5/1929 | Stoll . | |
| 2,827,955 | | 3/1958 | Hurley . | |
| 2,922,653 | | 1/1960 | O'Brien . | |
| 3,685,666 | | 8/1972 | Rose . | |
| 4,280,521 | | 7/1981 | Zeigler . | |
| 4,512,097 | | 4/1985 | Zeigler . | |
| 4,522,008 | | 6/1985 | Zeigler . | |
| 4,539,786 | | 9/1985 | Nelson . | |
| 4,561,618 | | 12/1985 | Zeigler . | |
| 4,657,149 | | 4/1987 | Masson . | |
| 4,658,560 | * | 4/1987 | Beaulieu | 52/646 |
| 4,667,833 | | 5/1987 | Jamison . | |
| 4,727,994 | | 3/1988 | Beaulieu . | |
| 4,747,239 | | 5/1988 | Zeigler . | |
| 4,770,086 | | 9/1988 | Gabster . | |
| 4,800,663 | | 1/1989 | Zeigler . | |
| 4,825,930 | | 5/1989 | Lindberg et al. . | |
| 4,888,895 | * | 12/1989 | Kenemy | 40/610 |
| 4,942,686 | | 7/1990 | Kemeny . | |
| 4,970,841 | | 11/1990 | Zeigler . | |
| 5,078,284 | | 1/1992 | Pirkl et al. . | |
| 5,125,205 | | 6/1992 | Wichman . | |
| 5,229,888 | * | 7/1993 | Gustafsson et al. | 359/804 |
| 5,327,700 | | 7/1994 | Sorenson et al. . | |
| 5,375,641 | | 12/1994 | Schlueter . | |
| 5,501,051 | * | 3/1996 | Harlan | 52/646 |
| 5,553,648 | | 9/1996 | Goharjou . | |
| 5,903,993 | | 5/1999 | Maticko et al. . | |

* cited by examiner

*Primary Examiner*—Carl D. Friedman
*Assistant Examiner*—Steve Varner
(74) *Attorney, Agent, or Firm*—Raymond Sun

(57) ABSTRACT

A channel bar assembly is provided for use with a modular display system. The modular display system can have a display frame that is made up of a plurality of legs that are coupled to a plurality of hubs. The channel bar assembly includes a first channel bar and a second channel bar, each channel bar having a first end and a second end, and a hub connector having a first end hingedly coupled to the second end of the first channel bar, and a second end hingedly coupled to the first end of the second channel bar. The hub connector is connected to one of the plurality of hubs.

20 Claims, 8 Drawing Sheets

CHANNEL BAR ASSEMBLY FOR MODULAR DISPLAY SYSTEMS

BACKGROUND OF THE INVENTION

1. Field of the Invention

The present invention relates to modular display systems, and in particular, to a channel bar assembly that can be used to support displays or other materials to the face or front of a modular display system.

2. Description of the Prior Art

Modular display systems are commonly used at trade shows or exhibitions to display or exhibit photographs, promotional material, product samples, messages and other communication media. A conventional modular display system typically includes display frames that are provided in the form of tubings, panels that are typically made of a strong durable fabric material, and lighting assessories. The tubings, fabric and lighting are usually provided in separate pieces that are packed and stored in a storage case for transportation to the site of the trade show or exhibit. These components are then assembled at the site to create the display system.

Convenience is a very important factor in the use of modular display systems. The convenience factor relates not only to ease of storage and transportation, but also to assembly and disassembly of the modular display system. While many modular display systems are designed so that the display frames are easily and conveniently set up and taken down, the fabric panels can be more troublesome. In most modular display systems, vertical channel bars are attached to the display frame along each of the vertical rows of rods to support or attach the fabric panels. In the past, these channel bars had been provided in the form of individual sections that needed to be assembled and disassembled separately. Providing separate individual pieces suffers from several drawbacks. First, the provision of separate individual pieces will increase the number of separate parts that need to accompany the modular display system. Second, each individual piece needs to be correctly oriented before attaching it to the display frame, which requires more time to install the channel bars.

To address these drawbacks, U.S. Pat. No. 5,125,205 to Wichman discloses another type of channel bar in FIGS. 10 and 11, where the sections are hinged together so that the channel bar can be attached as a unit or folded for storage. Keyslots are provided on the sections for releasably engaging the knobs on the hubs of the display frame. Unfortunately, the hinged channel bars in U.S. Pat. No. 5,125,205 suffer from the drawback that releasable engagement between the knobs and keyslots can be easily detached.

Thus, there still remains a need for channel bars that are easy to install and to dis-assemble, and which provide stable support for heavy fabric panels.

SUMMARY OF THE DISCLOSURE

In order to accomplish the objects of the present invention, there is provided a channel bar assembly for use with a modular display system. The modular display system can have a display frame that is made up of a plurality of legs that are coupled to a plurality of hubs. The channel bar assembly according to the present invention includes a first channel bar and a second channel bar, each channel bar having a first end and a second end, and a hub connector having a first end hingedly coupled to the second end of the first channel bar, and a second end hingedly coupled to the first end of the second channel bar. The hub connector is connected to one of the plurality of hubs.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

The channel bar assembly according to the present invention provides a row of channel bars that can both be hinged and folded. A plurality of hub connectors are provided to connect the channel bar assembly to the hubs of the modular display system, and to connect adjacent channel bars. The channel bars may be hinged about the hub connectors to be folded into a stack of channel bars that facilitate convenient storage.

Figure 1:
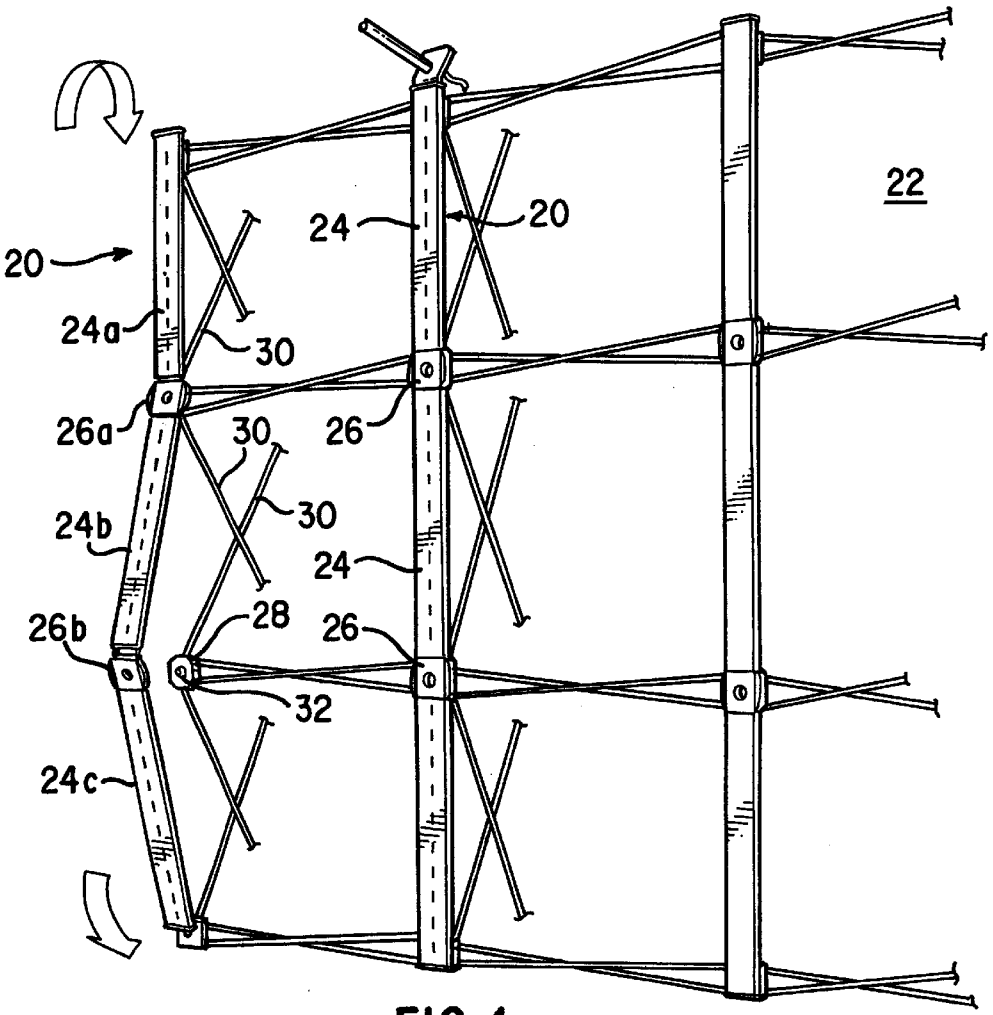
FIG. 1 is a perspective view of a modular display system showing a plurality of channel bar assemblies according to the present invention in use therewith.

FIG. 1 illustrates a plurality of channel bar assemblies 20 of the present invention in use with a modular display system 22. Each channel bar assembly 20 has one row of channel bars 24*a*, 24*b*, 24*c* and hub connectors 26*a*, 26*b* that are aligned along a row of the hubs 28 of the modular display system 22. A plurality of channel bar assemblies 20 are provided to extend across the entire modular display system 22.

The modular display system 22 comprises a display frame that has a plurality of foldable crossing legs 30 that are connected to hubs 28. The legs 30 can be formed from tubular members. Each hub 28 has a peg 32 that is used to secure the hub connectors 26 (as described below). A variety of different embodiments for the legs 30 and the hubs 28 are well-known in the art, and are not described in greater detail herein. The only requirement for the present invention is that each hub 28 be provided with a peg 32.

Figure 2:
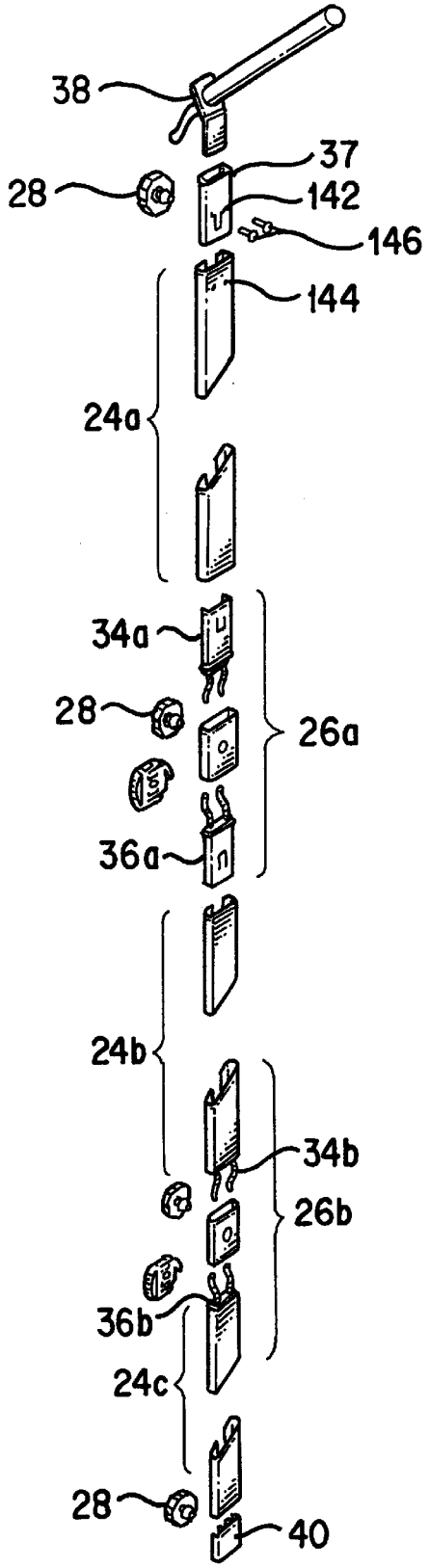
FIG. 2 is an exploded perspective view of one channel bar assembly of FIG. 1.
Figure 3:
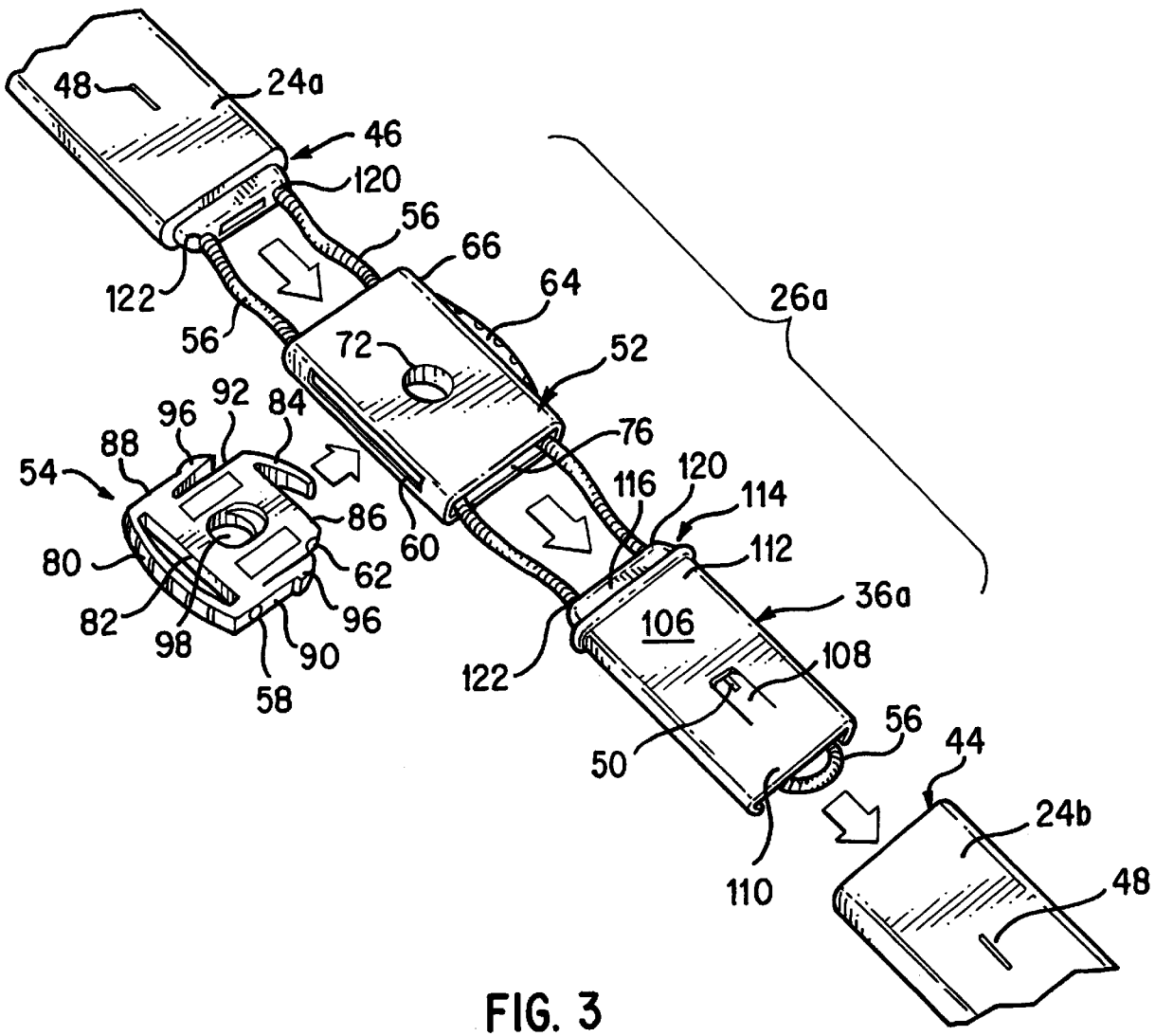
FIG. 3 is an exploded view of a section of the channel bar assembly of FIG. 2.

Each channel bar assembly 20 is illustrated in greater detail in FIGS. 2 and 3. The channel bar assembly 20 can have an upper channel bar 24*a*, a first hub connector 26*a*, an intermediate channel bar 24*b*, a second hub connector 26*b*, and a lower channel bar 24*c*. The first hub connector 26*a* has a first anchor 34*a* that connects the upper channel bar 24*a*, and a second anchor 36*a* that connects the intermediate channel bar 24*b*, and the second hub connector 26*b* has a first anchor 34*b* that connects the intermediate channel bar 24*b* and second anchor 36*b* that connects the lower channel bar 24*c*. A light or top anchor 37 is secured to the top of the upper channel bar 24*a* for retaining a conventional light fixture 38 and for securing a hub 28 (as described in connection with FIGS. 6 and 7 below), and a base anchor 40 is secured to the bottom of the lower channel bar 24*c* for securing another hub 28 (as described in connection with FIG. 8 below).

Each channel bar 24*a*–24*c* can be a generally rectangular or U-shaped piece having a hollow interior and opposing openings 44 and 46 at each opposing end. A slot 48 is provided near each opening 44, 46 and is adapted to receive a detent rib 50 from an anchor 34 or 36.

Figure 4:
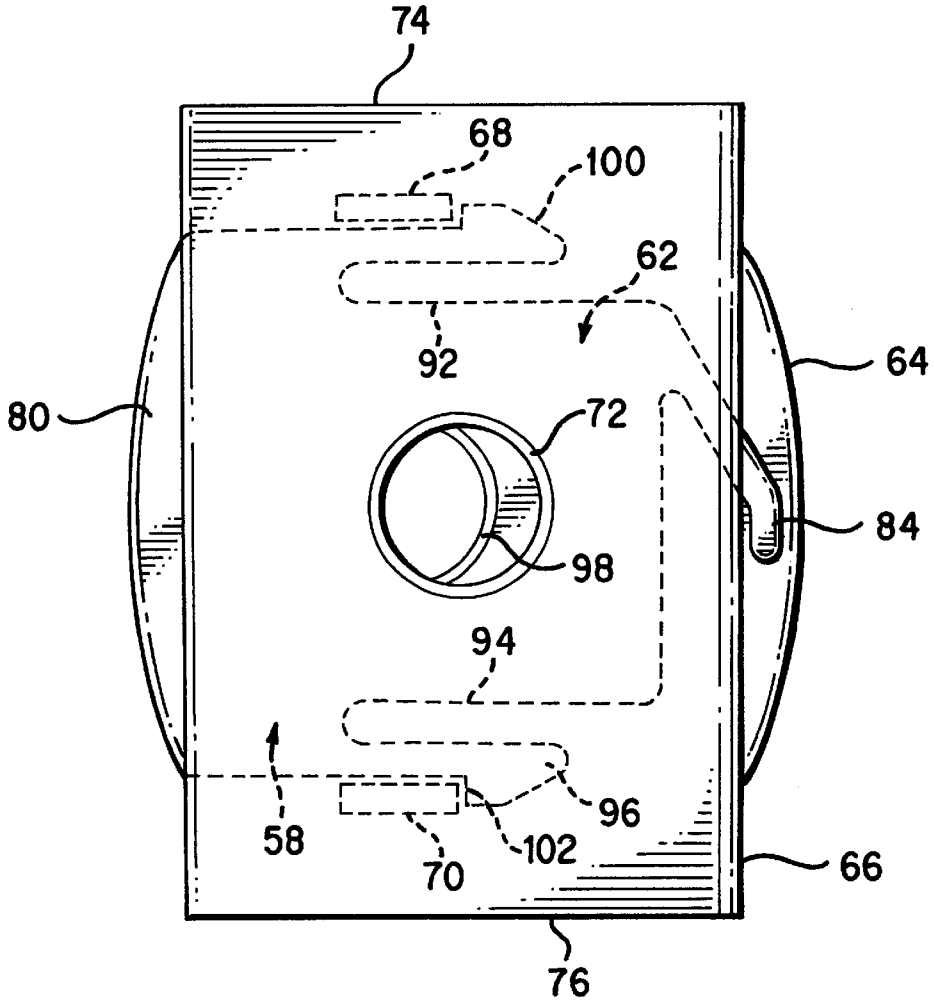
FIG. 4 is a front plan view of the hub connector of the channel bar assembly of FIG. 2.

FIGS. 3 and 4 illustrate the hub connector 26*a*, although the other hub connector 26*b* can be identical in structure and operation. The hub connector 26*a* has a knuckle housing 52, a spring release locker piece 54 that is adapted to be fitted inside the housing 52, and a first anchor 34*a* and a second anchor 36*a* that are connected to the housing 52 by a looped flexible connector 56 in the manner described below. The looped flexible connector 56 can an elastic or non-elastic cord or rope or similar connector.

The housing 52 is generally rectangular and has a hollow interior that communicates with a left elongated opening 60. An arcuate wall 64 extends along the right side 66 of the housing 52. Two stopper pillars 68 and 70 (shown in phantom in FIG. 4) are positioned inside the hollow interior of the housing 52. A central circular opening 72 extends through the housing 52. The housing 52 has an elongated upper opening 74 and an elongated lower opening 76.

The spring release locker piece 54 has a generally four sided configuration, with an arcuate band 80 extending longitudinally along and away from the left side 82 of the locker piece 54. A flexible tongue 84 extends at a longitudinal angle along a portion of the right side 86 of the locker piece 54. Two opposing flexible grips 88 and 90 extend longitudinally along a portion of the top side 92 and the bottom side 94, respectively, of the locker piece 54. Each flexible grip 88 and 90 can have a hooked end 96 that extends away from the locker piece 54. Each hooked end 96 has an angled surface 100 and a stop surface 102 extending from the angled surface 100. The band 80, tongue 84 and grips 88 and 90 can be made or molded from the same material as the locker piece 54. A central circular opening 98 extends through the locker piece 54. A first bore or channel 58 extends from the top side 92 to the bottom side 94 adjacent the left side 82, and a second bore or channel 62 extends from the top side 92 to the bottom side 94 adjacent the right side 86.

As shown in FIGS. 3 and 4, the locker piece 54 can be inserted into the housing 52 via the left elongated opening 60 of the housing 52, and movably retained in the housing 52. The right side 86 of the locker piece 54 is inserted first, and the angled surfaces 100 of the grips 88 and 90 will slide against the stopper pillars 68 and 70, respectively, pushing the grips 88 and 90 inwardly towards the top side 92 and bottom side 94, respectively, of the locker piece 54. When the hooked ends 96 of the grips 88 and 90 pass the stopper pillars 68 and 70, respectively, the grips 88 and 90 will be biased away from the top side 92 and bottom side 94, respectively, to lock or secure the locker piece 54 in place inside the housing 52. FIG. 4 shows the locker piece 54 locked in place inside the housing 52, with the stop surfaces 102 of the grips 88 and 90 abutting the pillars 68 and 70, respectively, to prevent the locker piece 54 from being pulled out of the housing 52 via the left elongated opening 60. The tongue 84 is biased against the arcuate wall 64 to bias the locker piece 54 in the direction of the left elongated opening 60, so as to secure the locker piece 54 inside the housing 52 (which occurs because the stopper pillars 68, 70 limit the movement of the locker piece 54 in the direction of the left elongated opening 60). In addition, the opening 72 of the housing 52 is normally mis-aligned with the opening 98 of the locker piece 54 to form an eyelet-shaped combined opening as shown in FIG. 4. If desired, the locker piece 54 can be removed from the housing 52 by removing the cord 56 from the housing 52 and locker piece 54, using an instrument to simultaneously push the grips 88 and 90 inwardly towards towards the top side 92 and bottom side 94, respectively, to clear the stopper pillars 68 and 70, and then pulling the locker piece 54 out of the housing 52. The instrument can access the grips 88 and 90 via the upper and lower openings 74 and 76, respectively.

A first end of the cord 56 is secured inside the anchor 34*a*, with the second end of the cord 56 extending from one opening 120 of the male extension 116 of anchor 34*a* and through the elongated upper opening 74 of the housing 52. The cord 56 extends through the second bore 62 of the locker piece 54 and the elongated lower opening 76 of the housing 52 into an opening 120 in the male extension 116 of the anchor 36*a*. The second end of the cord 56 is then looped inside the anchor 36*a* to exit another opening 122 in the male extension 116 of the anchor 36*a* to extend back through the lower opening 76, the first bore 58, the upper opening 74 and an opening 122 in the male extension 116 of anchor 34*a*. The two ends of the cord 56 are crimped so that the cord 56 forms a loop.

Referring to FIGS. 2 and 3, each anchor 34 and 36 can have the same structure and operation, so only the anchor 36*a* will be described in greater detail. The anchor 36*a* can be a rectangular piece having a hollow interior. The anchor 36*a* is preferably sized and configured so that it can slide into an opening 44 or 46 of any channel bar 24. In this regard, the anchor 36*a* is preferably slightly smaller than the channel bars 24, and has the same rectangular configuration to fit inside a channel bar 24. The body 106 of the anchor 36*a* has a detent 108 cut from a portion thereof, with a detent rib 50 provided on the detent 108. Thus, the anchor 36*a* can be secured to a channel bar 24 by sliding the outer end 110 of the anchor 36*a* into the opening 44 or 46, with the rib 50 causing the cut detent 108 to be pushed inwardly until the rib 50 reaches the slot 48, where the rib 50 will be seated in the slot 48 to lock the anchor 36*a* in place inside the channel bar 24. To separate the anchor 36*a* from the channel bar 24, the detent rib 50 is pushed inwardly to disengage the connection, and the anchor 36*a* pulled out of the channel bar 24. The opposing inner end 112 of the anchor 36*a* has a cap 114 with a male extension 116 that is sized and configured to be inserted into, and to fit inside, either the upper opening 74 or the lower opening 76 of the housing 52.

Each hub connector 26 can be assembled in the following manner, as described in connection with hub connector 26*a* and FIGS. 3–5. First, referring to FIG. 3, the locker piece 54 is inserted into and secured inside the housing 52 according to the method described above in connection with FIG. 4. The cord 56 is then threaded through the male extensions 116 of the anchors 34*a* and 36*a*, the housing 52 and the locker piece 54 in the manner described above to create a looped cord 56. The two anchors 34*a* and 36*a* are then secured to their adjacent channel bars 24*a* and 24*b*, respectively. This can be accomplished by sliding the outer ends 110 of the anchors 34*a* and 36*a* into the openings 46 and 44, respectively, of the channel bars 24*a* and 24*b*, respectively, until the detent ribs 50 on each anchor 34*a* and 36*a* are secured in the slots of the channel bars 24*a* and 24*b*, respectively. Finally, the caps 114 of the anchors 34*a* and 36*a* are then inserted through the elongated openings 74 and 76, respectively, of the housing 52, to reach the configuration shown in FIG. 5.

Figure 5:
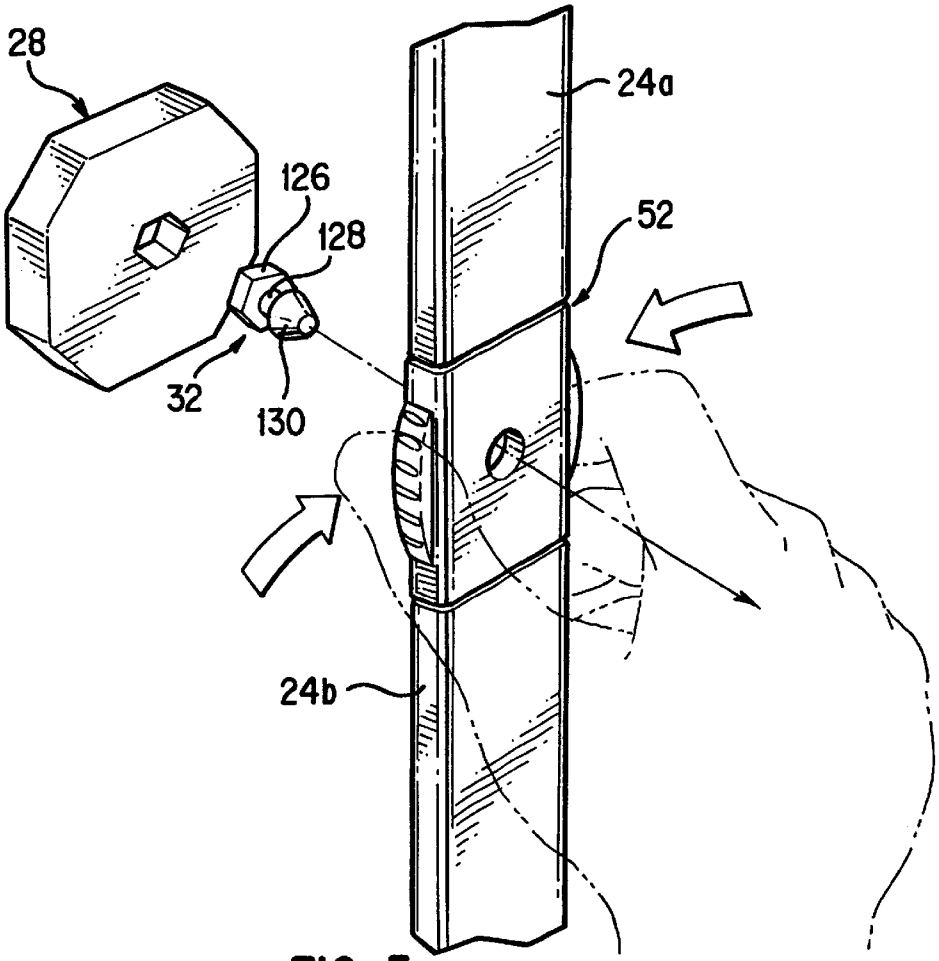
FIG. 5 illustrates how the hub connector of FIG. 4 is used to connect a hub of the modular display system.

Referring now to FIG. 5, each hub 28 has a peg 32. The peg 32 has a main body 126 that is secured to the hub 28, and has a shaft 128 extending from the body 126 and terminating at an enlarged but tapered end 130. The enlarged end 130 can be inserted through the openings 72 and 98 of the housing 52 and the locker piece 54, respectively, with the shaft 128 retained inside the housing 52 and the enlarged end 130 extending from the housing 52 to support the fabric panels. In particular, referring to FIG. 4, the openings 72 and 98 are normally mis-aligned. Since both openings 72 and 98 are sized to be larger than the enlarged end 130, the enlarged end 130 can pass through the openings 72 and 98 when they are aligned. The openings 72 and 98 can be aligned by pushing the band 80, such as using two fingers to grip the band 80 and the arcuate wall 64 as shown in FIG. 5. Specifically, pushing the band 80 will push the locker piece 54 inwardly (with the tongue 84 biasing the locker piece 54 against the arcuate wall 64), causing the opening 98 to slide in the direction of the right side 66 of the housing 52 until the openings 72 and 98 are aligned. Thus, the orientation of the combined opening formed by the openings 72 and 98 can be changed from a generally circular combined opening (when aligned) to an eyelet-shaped combined opening (when mis-aligned). When the band 80 is released, the locker piece 54 will be biased back into the position shown in FIG. 4, where the openings 72 and 98 are mis-aligned. The mis-aligned openings 72 and 98 (i.e., the eyelet opening) will grip the shaft 128 of the peg 32, but the resulting opening will be small enough to prevent the enlarged end 130 from being withdrawn through the openings 72 and 98.

To disconnect the hub connector 26*a* from the hub 28, the user merely pushes the band 80 again to align the openings 72 and 98, and then withdraws the enlarged end 130 through the openings 72 and 98.

Figure 6:
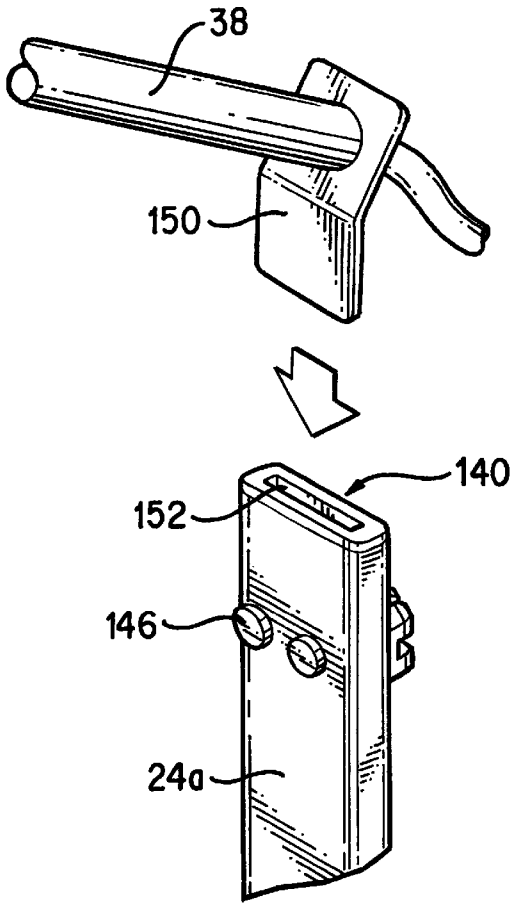
FIG. 6 is an exploded front sectional view illustrating how a light fixture is attached to the top of the channel bar assembly of FIG. 2.
Figure 7:
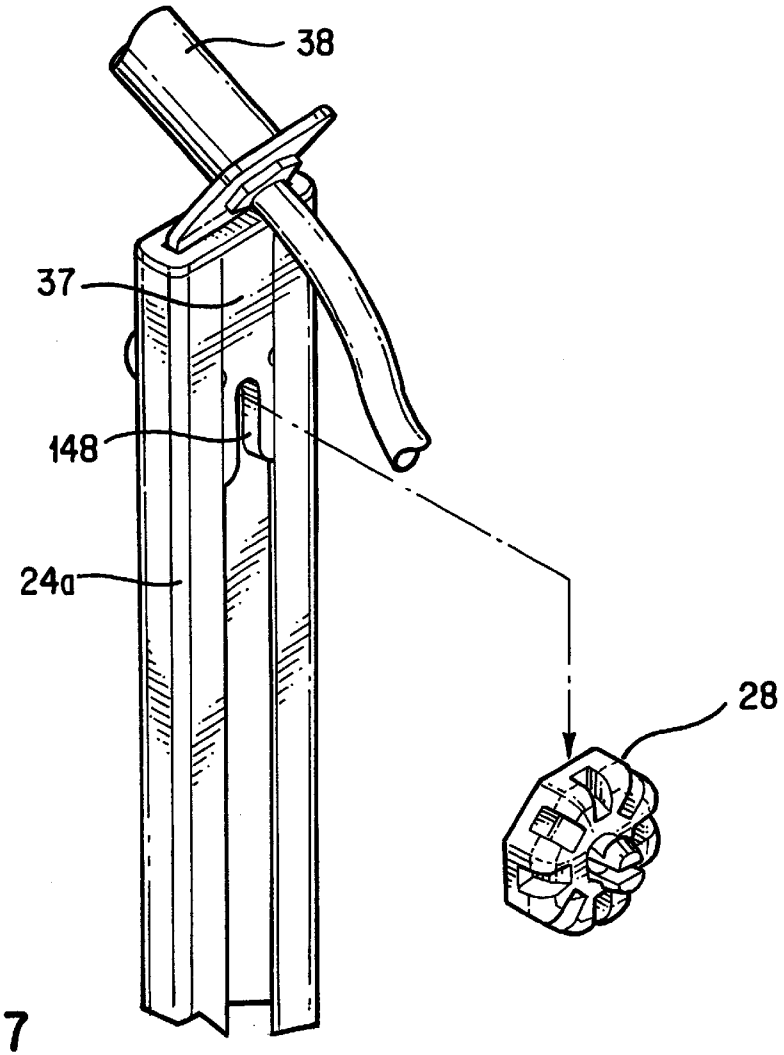
FIG. 7 is an exploded rear sectional view of the light fixture and the channel bar assembly of FIG. 6, illustrating how a hub of the modular display system is connected to the top of the channel bar assembly.

FIGS. 2, 6 and 7 illustrate how the top of the channel bar 24*a* is connected to the top-most hub 28, and how the light fixture 38 is coupled to the channel bar 24*a*. A light or top anchor 37 is inserted into the top opening 140 of the channel bar 24*a* in a similar manner as the anchors 34*a* and 36*a* being inserted into the channel bars 24*a* and 24*b*, respectively. The anchor 37 can also be a rectangular piece having a hollow interior, and is preferably sized and configured so that it can slide into the top opening 140 of the channel bar 24*a*. In this regard, the anchor 37 is preferably slightly smaller than the channel bar 24*a*, and has the same rectangular configuration to fit inside a channel bar 24*a*. The body of the anchor 37 also has a detent cut from a portion thereof, similar to the anchors 34*a* and 36*a*, and operates in the same way to secure itself to the inside of the channel bar 24*a*. The anchor 37 has two openings 142 that are aligned with two openings 144 on the channel bar 24*a* for receiving two pegs 146. The pegs 146 are used to support the fabric panels. The rear side of the anchor 37 has a slot 148 into which the top hub 28 can be inserted (see FIG. 7) in a manner that is well-known in the art. The light fixture 38 has a vertical section or bracket 150 that can be inserted through the top opening 152 of the anchor 37 for retention therein (see FIG. 6).

Figure 8:
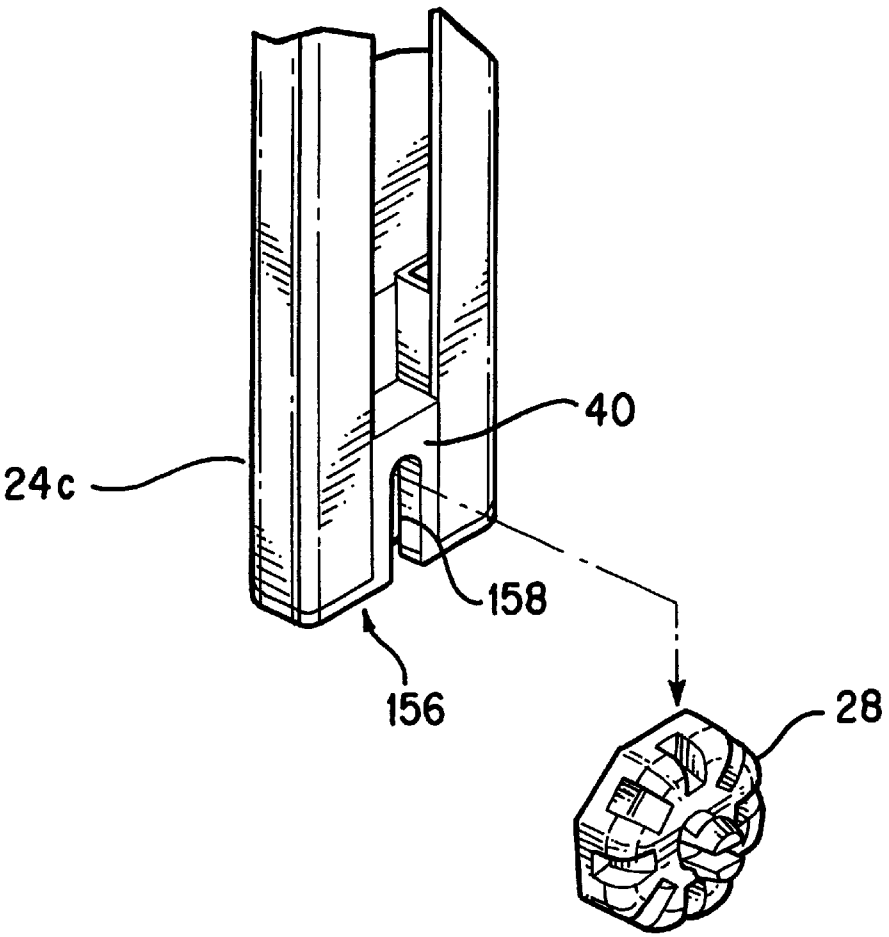
FIG. 8 is an exploded rear sectional view illustrating how a hub of the modular display system is connected to the bottom of the channel bar assembly of FIG. 2.

FIGS. 2 and 8 illustrates how the bottom of the channel bar 24*c* is connected to the bottom-most hub 28. A base anchor 40, which can have a structure similar to that of the light anchor 37, is inserted into the bottom opening 156 of the channel bar 24*c* in the same manner as the anchor 37. The rear side of the anchor 40 also has a slot 158 into which the bottom hub 28 can be inserted in a manner that is well-known in the art.

The entire channel bar assembly 20 can be assembled in the following manner. Referring to FIG. 1, the top of the upper channel bar 24*a* is first secured to the top-most hub 28 in the manner described in FIGS. 6 and 7. Next, the bottom of the lower channel bar 24*c* is secured to the bottom-most hub 28 in the manner described in FIG. 8. Then, the two hub connectors 26*a* and 26*b* are secured to the two intermediate hubs 28 in the manner described in connection with FIGS. 3–5. The light fixture 38 can then be mounted to the light anchor 37. Thus, the assembly of each channel bar assembly 20 is simple and convenient.

To dis-assemble the assembly 20, the hub connectors 26*a*, 26*b* are first separated from the intermediate hubs (according to the method described in FIGS. 3–5 above), and then the anchors 37 and 40 are separated from the top and bottom hubs, respectively.

In addition, the storage of each channel bar assembly 20 is also simple and convenient. Referring to FIGS. 1 and 2, the anchors 34, 36, 37 and 40 can be kept inside each respective channel bar 24 for storage, and each cap 114 can be separated from its corresponding housing 52. Each channel bar 24 can then be folded about the hinges defined by the cord 56 on either side of the housing 52 to form a stack of channel bars 24 for storage. In other words, each hinge is defined by the portion of the cord 56 that extends between either the upper or lower opening 74 or 76 of the housing 52 and the cap 114 of the adjacent anchor 34 or 36. As a result, the two hinges are defined by portions of the cord 56 that extend between the housing 52 and an adjacent anchor 34 or 36, as shown in FIG. 3.

As an alternative, the single looped cord 56 can be replaced by four separate cords, with two separate cords extending between the housing 52 and the anchor 34*a* to form one hinge, and the other two cords extending between the housing 52 and the other anchor 36*a* to form another hinge.

Those skilled in the art will appreciate that the embodiments and alternatives described above are non-limiting examples only, and that certain modifications can be made without departing from the spirit and scope thereof. The accompanying claims are intended to cover such modifications as would fall within the true scope and spirit of the present invention.

What is claimed is:

1. A channel bar assembly, including:

a first channel bar and a second channel bar, each channel bar having a first end and a second end; and a hub connector having a first end hingedly coupled to the second end of the first channel bar, and a second end hingedly coupled to the first end of the second channel bar, wherein the hub connector includes a first flexible connector coupling the first end of the hub connector to the second end of the first channel bar, and a second flexible connector coupling the second end of the hub connector to the first end of the second channel bar.

2. The assembly of claim 1, wherein the hub connector includes a first flexible connector coupling the first end of the hub connector to the second end of the first channel bar, and a second flexible connector coupling the second end of the hub connector to the first end of the second channel bar.

3. The assembly of claim 1, wherein the first end of the hub connector has a first anchor that is directly secured to the second end of the first channel bar, and which is coupled to the hub connector by the first flexible connector, and wherein the second end of the hub connector has a second anchor that is directly secured to the first end of the second channel bar, and which is coupled to the hub connector by the second flexible connector.

4. The assembly of claim 3, wherein each of the first and second anchors has a cap that is fitted inside a housing of the hub connector.

5. A channel bar assembly, including:

a first channel bar and a second channel bar, each channel bar having a first end and a second end; and a hub connector having a first end hingedly coupled to the second end of the first channel bar, and a second end hingedly coupled to the first end of the second channel bar, wherein the hub connector has an opening that can be changed in orientation from a smaller orientation to a larger orientation.

6. A channel bar assembly, including:

a first channel bar and a second channel bar, each channel bar having a first end and a second end; and a hub connector having a first end hingedly coupled to the second end of the first channel bar, and a second end hingedly coupled to the first end of the second channel bar, wherein the hub connector further includes a housing and a locker piece that is movably retained inside the housing, with the housing having a first opening and the locker piece having a second opening, wherein the first and second openings are normally mis-aligned, but are aligned when the position of the locker piece within the housing is adjusted.

7. The assembly of claim 6, wherein the housing has a first elongated side opening through which the locker piece can be inserted.

8. The assembly of claim 6, wherein the locker piece has a first side, and includes a flexible tongue extending along a portion of the first side.

9. The assembly of claim 8, wherein the housing has an elongated side opening through which the locker piece can be inserted, and an opposing arcuate wall, wherein the flexible tongue is positioned adjacent the arcuate wall of the housing when the locker piece is positioned inside the housing.

10. The assembly of claim 1, wherein the first and second flexible connectors comprise a looped cord extending from the first channel bar through the hub connector and to the second channel bar.

11. A modular display system, including:

(a) a display frame that is made up of a plurality of legs that are coupled to a plurality of hubs; and (b) a channel bar assembly, including:

(i) a first channel bar and a second channel bar, each channel bar having a first end and a second end; and (ii) a hub connector that is separate from the plurality of hubs and which includes a first end hingedly coupled to the second end of the first channel bar, and a second end hingedly coupled to the first end of the second channel bar, the hub connector being connected to one of the plurality of hubs.

12. A modular display system, including:

(a) a display frame that is made up of a plurality of legs that are coupled to a plurality of hubs; and (b) a channel bar assembly, including:

(i) a first channel bar and a second channel bar, each channel bar having a first end and a second end; and (ii) a hub connector having a first end hingedly coupled to the second end of the first channel bar, and a second end hingedly coupled to the first end of the second channel bar, the hub connector being connected to one of the plurality of hubs, wherein the hub connector includes a first flexible connector coupling the first end of the hub connector to the second end of the first channel bar, and a second flexible connector coupling the second end of the hub connector to the first end of the second channel bar.

13. The system of claim 12, wherein the first end of the hub connector has a first anchor that is directly secured to the second end of the first channel bar, and which is coupled to the hub connector by the first flexible connector, and wherein the second end of the hub connector has a second anchor that is directly secured to the first end of the second channel bar, and which is coupled to the hub connector by the second flexible connector.

14. The system of claim 13, wherein each of the first and second anchors has a cap that is fitted inside a housing of the hub connector.

15. A modular display system, including:

(a) a display frame that is made up of a plurality of legs that are coupled to a plurality of hubs; and (b) a channel bar assembly, including:

(i) a first channel bar and a second channel bar, each channel bar having a first end and a second end; and (ii) a hub connector having a first end hingedly coupled to the second end of the first channel bar, and a second end hingedly coupled to the first end of the second channel bar, the hub connector being connected to one of the plurality of hubs, wherein the hub connector has an opening that can be changed in orientation from a smaller orientation to a larger orientation, and wherein one of the hubs has a peg that extends through the opening when the opening is in the larger orientation, and that is secured to the hub connector when the opening is in the smaller orientation.

16. A modular display system, including:

(a) a display frame that is made up of a plurality of legs that are coupled to a plurality of hubs; and (b) a channel bar assembly, including:

(i) a first channel bar and a second channel bar, each channel bar having a first end and a second end; and (ii) a hub connector having a first end hingedly coupled to the second end of the first channel bar, and a second end hingedly coupled to the first end of the second channel bar, the hub connector being connected to one of the plurality of hubs, wherein the hub connector further includes a housing and a locker piece that is movably retained inside the housing, with the housing having a first opening and the locker piece having a second opening, wherein the first and second openings are normally mis-aligned, but are aligned when the position of the locker piece within the housing is adjusted, and wherein one of the hubs has a peg that extends through the first and second openings when the first and second openings are aligned, and that is secured to the housing when the first and second openings are mis-aligned.

17. The system of claim 16, wherein the housing has a first elongated side opening through which the locker piece can be inserted.

18. The system of claim 16, wherein the locker piece has a first sides, and includes a flexible tongue extending along a portion of the first side.

19. The system of claim 18, wherein the housing has a first elongated side opening through which the locker piece can be inserted, and an opposing arcuate wall, wherein the flexible tongue is positioned adjacent the arcuate wall of the housing when the locker piece is positioned inside the housing.

20. The system of claim 12, wherein the first and second flexible connectors comprise a looped cord extending from the first channel bar through the hub connector and to the second channel bar.

* * * * *